United States Patent [19]

Parton

[11] Patent Number: 4,635,437

[45] Date of Patent: Jan. 13, 1987

[54] CHAIN PUNCH

[75] Inventor: Kenny R. Parton, Broken Arrow, Okla.

[73] Assignee: R. W. Steele, II, Tulsa, Okla.

[21] Appl. No.: 819,742

[22] Filed: Jan. 21, 1986

Related U.S. Application Data

[62] Division of Ser. No. 630,274, Jul. 12, 1984, Pat. No. 4,581,825.

[51] Int. Cl.[4] ..... B21L 9/06

[52] U.S. Cl. ..... 59/7; 83/440.1; 83/620; 83/631; 30/358; 72/454; 29/522 A

[58] Field of Search ..... 83/440.1, 620, 622, 83/631, 685, 698, 691, 687; 30/358, 361; 59/7, 16; 72/454, 470; 29/243.53, 522 A

[56] References Cited

U.S. PATENT DOCUMENTS

| | | | |
|---|---|---|---|
| 287,417 | 10/1883 | Clark | 83/631 |
| 374,464 | 12/1887 | Farrin | 83/631 |
| 905,766 | 12/1908 | Torka | 30/358 |
| 2,248,111 | 7/1941 | Nassimbene | 83/631 |
| 2,747,362 | 5/1956 | Cox | 83/631 |
| 3,156,087 | 11/1964 | Granberg | 59/7 |
| 3,233,402 | 2/1966 | Urbaitis | 59/7 |
| 3,412,597 | 11/1968 | Rains | 59/7 |
| 4,365,401 | 12/1982 | Ogren | 59/7 |

*Primary Examiner*—Francis S. Husar
*Assistant Examiner*—David B. Jones
*Attorney, Agent, or Firm*—William S. Dorman

[57] ABSTRACT

A device for punching holes in a surveyor's chain and in metal pieces used for repairing the chain and for riveting together the punched chain and metal pieces comprising an elongated vertical housing having an elongated vertically oriented opening extending transversely therethrough and defined by a continuous wall, an upper vertical bore extending from the top of the housing into the vertical opening, a lower female die element received in the lower portion of the opening and having a flat horizontally extending recess therein whose width is equal to that of the chain to be repaired, the female die element also including a pair of spaced holes located on the flat recess, an upper male die member received in the upper portion of the opening and vertically slidable therein, the male die member having a pair of punching rods projecting downwardly, an arbor shaft having a threaded portion received in a threaded portion of the upper bore, a handle for rotating the arbor shaft, the arbor shaft having a lower portion adapted, upon rotation, to engage the upper end of the male die member for urging the male die member downwardly toward the female die member so as to urge the punching rods against a chain portion received in the flat recess on the female die member, whereby, upon continued rotation of the arbor shaft the punching rods will punch holes through the chain portion and pass at least partially into the openings in the female die member, and a lower handle or mounting for restraining rotation of the lower end of the housing. The device also includes rivet blocks to replace the die elements for securing rivets to overlapping prepunched metal strips.

2 Claims, 19 Drawing Figures

CHAIN PUNCH

This application is a division of application of Ser. No. 630,274, filed July 12, 1984, now U.S. Pat. No 4,581,825.

BACKGROUND OF THE INVENTION

1. Field of the Invention

The present invention relates to a device for punching surveyor's "chains" for repairing the same. Although the term "chain" is used in describing these measuring devices, they are actually in the form of a steel tape. In the time of George Washington, they were actually in the form of chains and the designation has persisted until today. More particularly the present invention relates to an improved punching device which can be carried in the field or which can be used on a work bench.

2. The Prior Art

A preliminary search was conducted on the above invention and the following U.S. Patents were uncovered as a result of the search:

| Name | Number | Date |
|---|---|---|
| Clark | 287,417 | Oct. 30, 1883 |
| Farrin | 374,464 | Dec. 6, 1887 |
| Nassimbene | 2,248,111 | July 8, 1941 |
| Cox | 2,747,362 | May 29, 1956 |

The Clark patent shows a tool for adding and removing rivets at the ends of belts. The Farrin patent shows a punch for punching holes in sheets of metal. The Nassimbene shows a device for splicing V-type belts. The Cox patent shows a device for removing rivets from a chain; the anvil shown in FIG. 3 of Cox is described as being movable.

When a surveyor's chain or tape breaks, one normally takes a strip of metal identical to the one from which the tape is made, punches holes in the ends of the repair strip, punches holes in the tape on the opposite sides of the break and then rivets the repair strip to the tape. Sometimes it is necessary to trim off material on the sides of the break which will then require accurately separating the broken ends from each other to insure a tape of the correct length. When a repair strip is added to, or inserted into, the chain it is necessary to punch two spaced holes at each location where the repair strip attaches to the chain so as to prevent pivoting of the repair strip with respect to the chain. At the present time, the punching procedure is generally accomplished by a hand held device similar to a pair of pliars and which will punch only one hold at a time.

SUMMARY OF THE INVENTION

The present invention involves a punching and riveting device including an elongated, vertically oriented, rectangular housing having a central oval shaped opening therein. The housing has an upper bore, the upper portion which is threaded, extending from the upper end of the housing into communication with the oval shaped opening. The housing also has a lower bore which extends from the bottom of the oval shaped opening to the bottom of the housing. A lower female die element is provided having a semi-cylindrical horizontal portion adapted to mate with the lower oval shape of the central opening and a cylindrical base adapted to be received in the upper end of the lower bore. The semi-cylindrical horizontal portion of the female die is provided with a horizontally extending flat recess whose width is exactly equal to the width of the tape or chain to be repaired. The flat surface also includes a pair of holes on opposite sides of the lower bore for receiving the punching elements of a male die member. The cylindrical base of the female die is provided with a pair of vertical grooves which are located below and in alignment with the punching holes to permit the discharging of punched material from the punching holes.

A male die member is also provided which is similar in shape to the upper portion of the female die member, in inverted position. The male die member includes a semi-cylindrical body having a lower flat surface and an upper curved portion which is adapted to mate with the upper portion of the oval opening. The flat surface on the male die member includes a pair of punching rods which project downwardly from the male die member in alignment with the punching holes in the female die member. These punching rods are preferably made of hardened steel. The male die member is also provided with a central vertical bore in alignment with the upper bore of the housing and which is adapted to receive the lower end of an arbor shaft.

A threaded arbor shaft is provided for moving the male die member towards the female die member. This arbor shaft includes a cylindrical member having a threaded portion adapted to be received in the upper threaded end of the upper bore. The lower end of the arbor shaft is provided with a cylindrical extension which is received in the vertical bore of the male die element. The upper end of the arbor shaft is provided with a hole through which a rod or handle projects on both sides of the arbor shaft. For use in the field, a similar rod or handle can be inserted through an appropriate hole in the bottom of the housing.

When it is directed to punch holes in the chain itself or in repair pieces, a metal strip is placed in the horizontal recess on the female die element and the upper rod handle is rotated while the lower rod or handle is held to keep the housing from rotating. Turning one handle with respect to the other will cause the male die member to move towards the female die member to punch holes in the middle of the strip.

For the riveting operation, a pair of upper and lower rivet blocks are used to replace the male and female die members, respectively. These rivet blocks are similarly shaped. However, instead of having holes in the lower rivet block as in the female die member, two similarly spaced shallow recesses are provided to receive the heads of a pair of inverted rivets. As far as the upper rivet block is concerned, a pair of flaring members extend downwardly from the flat surface in a manner similar to the punching rods on the male die member. With the rivet blocks in position and with a pair of prepunched strips being laid on the flat recesses on the lower punching blocks with the upper ends of the rivets projecting therethrough, the upper rivet block can be lowered towards the lower rivet block until the flaring members contact the upper ends of the rivets. Continued rotation of the arbor shaft will cause the flaring members to flare out the upper ends of the rivets so as to rivet the overlapping metal strips tightly together.

For the purpose of maintaining the metal strips in proper position, during the preliminary stages of the riveting operation, a horizontal holding pin is provided.

The housing is provided using a pair of pin holes extending through the housing on opposite sides of the oval shaped opening in a position above the upper end of the lower rivet block. The holding pin has a horizontal portion with a central bowed part. At one end of the horizontal portion is a right angled portion which serves as a turning handle. When the holding pin is turned by its handle, the bowed portion can bear against the overlapping strips to hold them in position during the preliminary stages of the riveting operation.

If it is desired to use the device of the present invention in a workshop or the like, the lower end of the housing can be restrained from rotation by means of a bench plate. The bench plate has a flat portion which is adapted to be bolted or otherwise secured to a bench. The flat portion has a vertical projection adapted to extend into the lower end of the housing, and a horizontal pin extends through complementary holes in the housing and in the vertical extension to prevent rotation of the lower end of the housing.

BRIEF DESCRIPTION OF THE DRAWINGS

FIG. 1 is a perspective view of the punching device of the present invention shown as mounted on a stand or bench plate which can be attached to a workbench or the like;

DETAILED DESCRIPTION OF THE PREFERRED EMBODIMENTS

Figure 1:
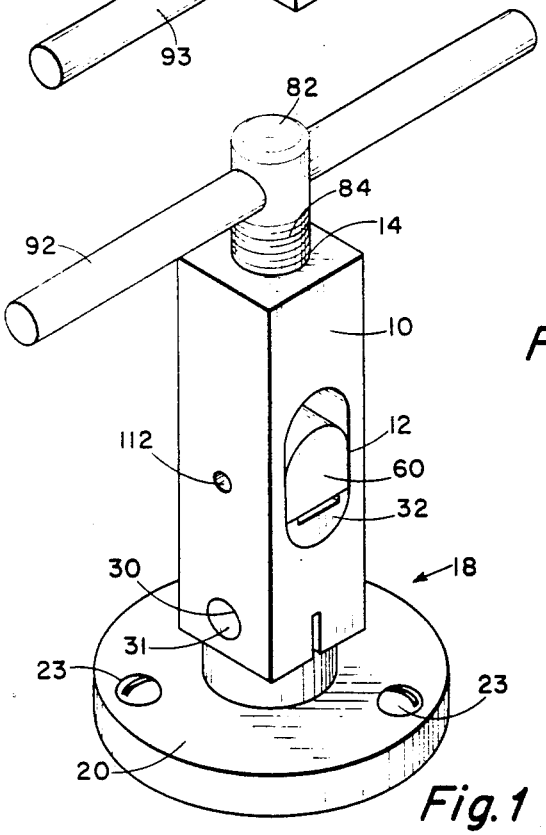
Figure 3:
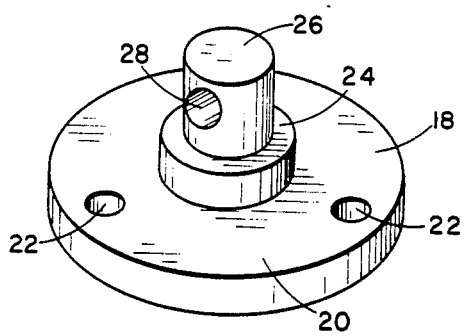
FIG. 3 is a perspective view of the stand or bench plate associated with the device of FIG. 1.

Turning now to the sheets of drawings, FIGS. 1, 2, 13, 14, 17 and 18 show a rectangular housing 10 having a central oval shaped opening 12 in which the slidable die elements will be mounted (as later to be described). The oval shaped opening 12 is defined by a continous wall which includes an upper portion and lower portion for purposes which will hereinafter appear, the housing 10 also includes an upper vertical threaded bore 16. For the purpose of mounting this device on a table or the like, there is provided a stand or bench plate 18 composed of a circular plate 20 having a plurality of vertical holes 22 which permit bolting of this plate to a table or other flat surface by means of bolts 23. As shown in FIG. 3, the base 18 includes a collar 24 and a cylindrical projection 26 whose external diameter is the same as the internal diameter of the bore 16. The cylindrical projection 26 has a horizontal bore 28 which is adapted to align with horizontal holes 30 in the housing 10. The housing 10 is received on the support as shown in FIG. 1, and a horizontal pin 31 can be inserted through the opening 30 and the bore 28 to lock the housing 10 on the support 18.

Figure 4:
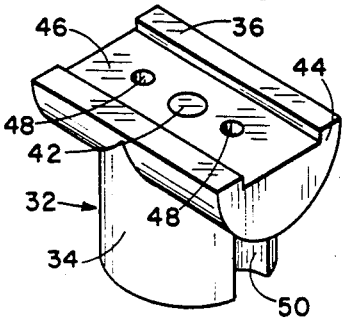
FIG. 4 is a perspective view of the lower female punching die.
Figure 5:
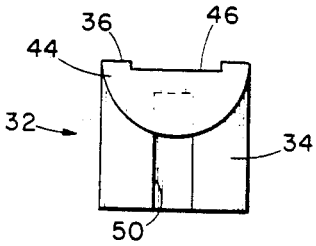
FIG. 5 is an end view of the punching die shown in FIG. 4.
Figure 6:
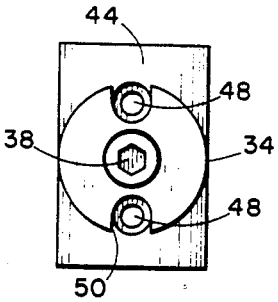
FIG. 6 is a bottom view of the punching die shown in FIG. 4.
Figure 15:
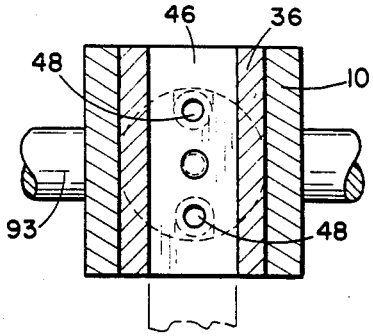
FIG. 15 is a sectional view taken along section line 15—15 of FIG. 13.
Figure 16:
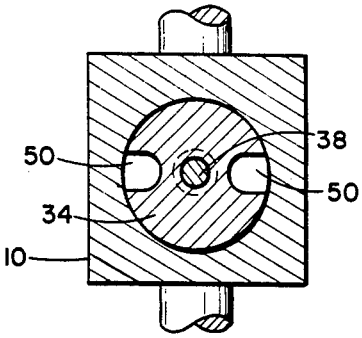
FIG. 16 is a sectional view taken along section line 16—16 of FIG. 14.
Figure 13:
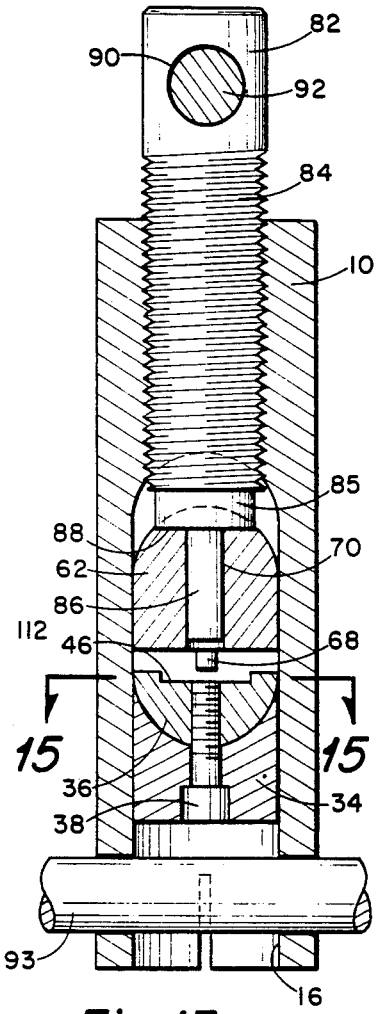
FIG. 13 is a longitudinal sectional view, on a slightly enlarged scale, of the device shown in FIG. 2 as employed for a punching operation.

The lower female punching die is shown in FIGS. 4, 5, and 6. This die 32 includes a lower cylindrical base 34 having an outer diameter equal to the inner diameter of the bore 16. The die 32 also includes a semi-cylindrical horizontal portion 36 which is attached to the base 34 by means of a screw 38 which passes through a hole 40 in the base 34 and which is received in a threaded opening 42 in the semi-cylindrical member 36. The outer curvature 44 of the cylindrical member 36 corresponds exactly with the curvature of the lower portion of the oval opening 12 in the housing 10. Thus, when the die 32 is slipped into the opening 12, the lower portion 34 can be received in the upper portion of the bore 16. The die 32 also includes a flat recess 46 whose width is exactly equal to the width of the tape or chain to be repaired. Also included on the flat surface 46 are a pair of holes 48 on opposite sides of the threaded bore 42 to receive the the punching elements of the male die later to be described. The base member 34 is provided with two vertical grooves 50 and 52 which are located below and in alignment with the holes 48 to permit the discharge of punched materials from the holes 48.

Figure 2:
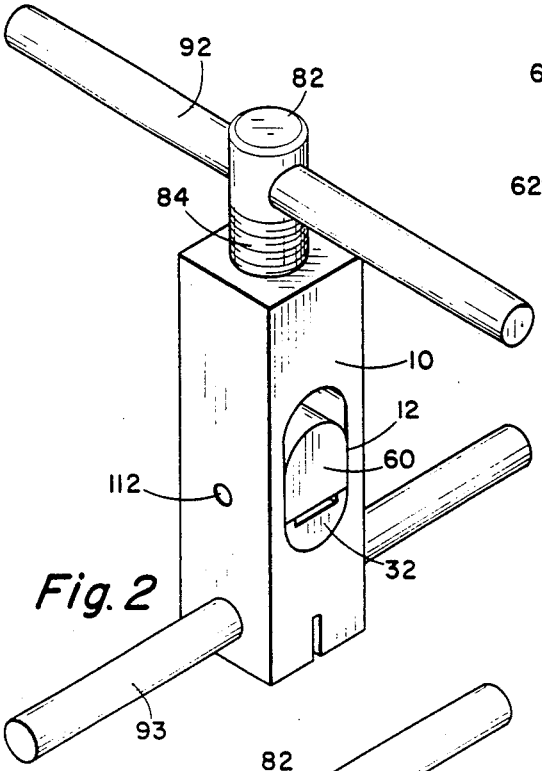
FIG. 2 is a view of the same device shown in FIG. 1 adapted for use in the field.
Figure 7:
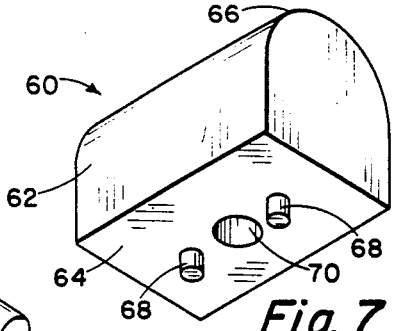
FIG. 7 is a perspective view of the upper male punching die.

The male die member or punch 60 is shown in FIG. 7. This punch includes a semi-cylindrical body 62 having a lower flat surface 64 and an upper curved portion 66 which is adapted to mate with the upper portion of the oval opening 12. A pair of punching rods 68 project downwardly from the flat surface 64 and are disposed precisely over the openings 48 in the female die member 32. These punching rods 68 are preferably made out of some type of hardened steel. The male die member 60 is also provided with a central vertical bore 70, (see now FIGS. 13 and 14) the upper end of which is adapted to receive the lower end of an arbor shaft later to be described. At the upper end of the vertical bore 70 is a cylindrical recess 72 (see FIG. 14) adapted to receive the larger cylindrical portion of the arbor shaft as will also hereinafter appear.

Figure 12:
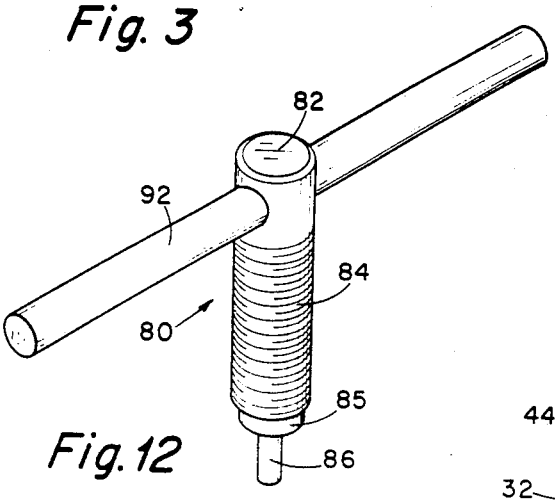
FIG. 12 is a perspective of the arbor and associated handle.
Figure 14:
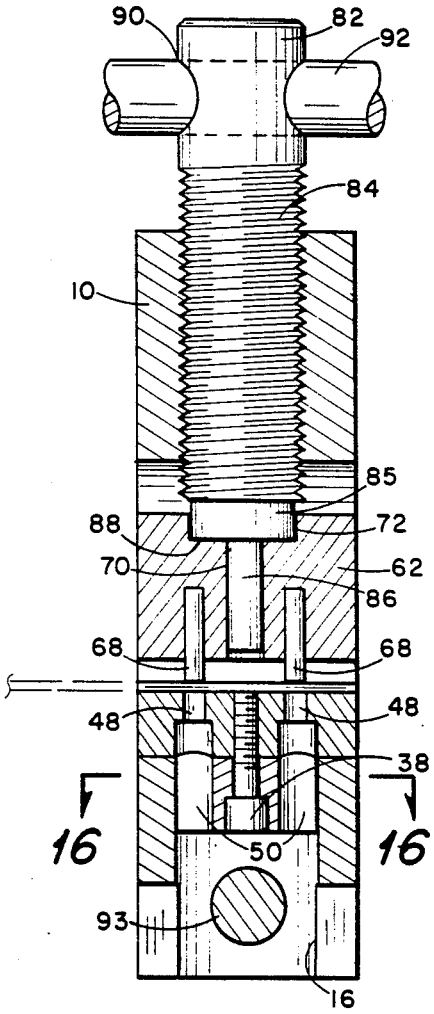
FIG. 14 is a longitudinal cross-sectional view taken at right angles to the sectional view of FIG. 13.

The threaded arbor shaft 80 is shown in FIG. 12. This shaft includes a cylindrical member 82, the lower portion of which is threaded as 84. The threaded portion 84 is adapted to be received in the upper threaded opening 14 of the housing 10. The lower end of the shaft 82 is provided with a reduced collar 85 and a cylindrical extension 86 of further reduced diameter. This lower cylindrical extension 86 is adapted to be received in the vertical bore 70 of the male die element 60, whereas the collar 85 is adapted to be received in the cylindrical recess 72. The lower end of the collar 85 is flattened as at 88 so as to fit against the bottom of the cylindrical recess 72 while the cylindrical projection 86 simulatenously is received within the vertical bore 70 as shown in FIG. 14. The upper end of the shaft 82 is provided with a horizontal hole 90 through which a rod 92 projects on opposite sides of the shaft 82. The member 92 constitutes a handle for turning the shaft 82. A similar rod or handle 93 can be inserted in the hole 30 when using the device of the present invention in the "field".

When it is desired to punch holes in the chain itself or in the repair piece, the metal strip is placed in the horizontal recess 46 and aligned with one side or the other of this recess 46 so that the holes would be punched in the proper position. Thereafter, the handle 92 is turned so that the punching elements 68 pass through the strip and into the holes 48 in the female die 32.

Figure 8:
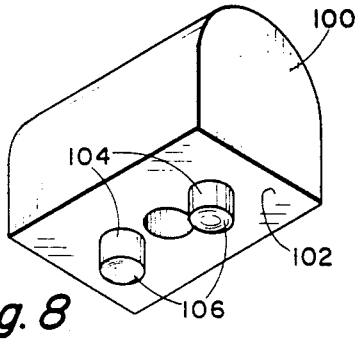
FIG. 8 is a perspective view of the upper rivet block.
Figure 11:
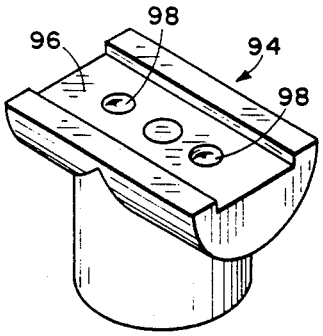
FIG. 11 is a perspective view of the lower rivet block.

After the required number of punching operations (generally three) have been completed, the die elements 32 and 60 are removed from the housing 10 and are replaced with the rivet blocks shown in FIGS. 8 and 11.

Figure 10:
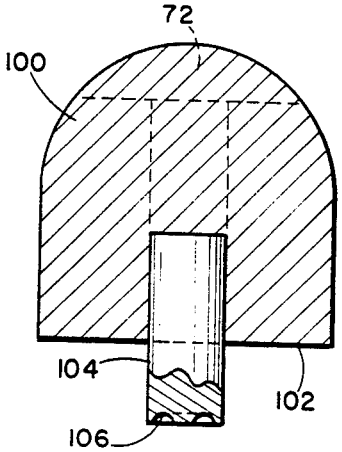
FIG. 10 is a cross-sectional view, on a slightly larger scale through the upper rivet block and also showing the lower section of the flaring member in section.
Figure 9:
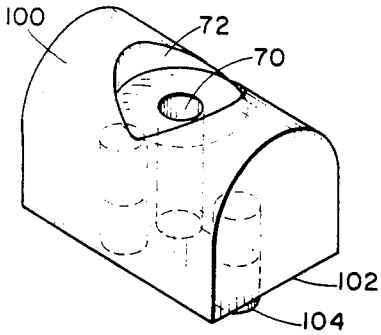
FIG. 9 is an opposite perspective view of the upper rivet block showing the flaring members in dotted lines.

The lower rivet block 94 is shown in FIG. 11 and corresponds with the lower die 32 shown in FIG. 4 as far as its external configuration is concerned. Briefly, the lower rivet block 94 includes a horizontal recess 96 which is exactly the same width and depth as the recess 46 previously described. A pair of shallow recesses 98 are located in the surface 46 and are adapted to receive the heads of a pair of rivets. It should be mentioned, at this point, that the punched tape portions and the repair strip are riveted in two operations. One end of the tape is properly aligned with a pair of holes in the repair strip, a pair of rivets are inserted and the combined strips are laid over the recess 96 with the heads of the rivets received in the shallow recesses 98. The upper die 60 has already been replaced by the upper rivet block 100 shown in FIGS. 8, 9 and 10 The upper rivet block 100 will mate with the lower end of the arbor 80 shown in FIG. 12 in the same manner as described above with respect to the upper punching block. The lower flat surface 102 of the rivet block 100 is provided with a pair of downwardly projecting flaring members 104 having circumferential recesses 106 therein. When the handle 92 is turned, the flaring members will contact the upper ends of the rivets and flare them outwardly to make a proper riveted connection between the repair strip and the adjacent ends of the broken tape.

Figure 19:
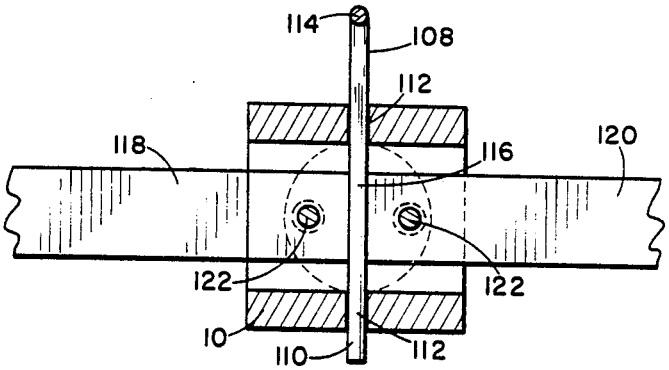
FIG. 19 is a sectional view taken along section line 19—19 of FIG. 18.
Figure 17:
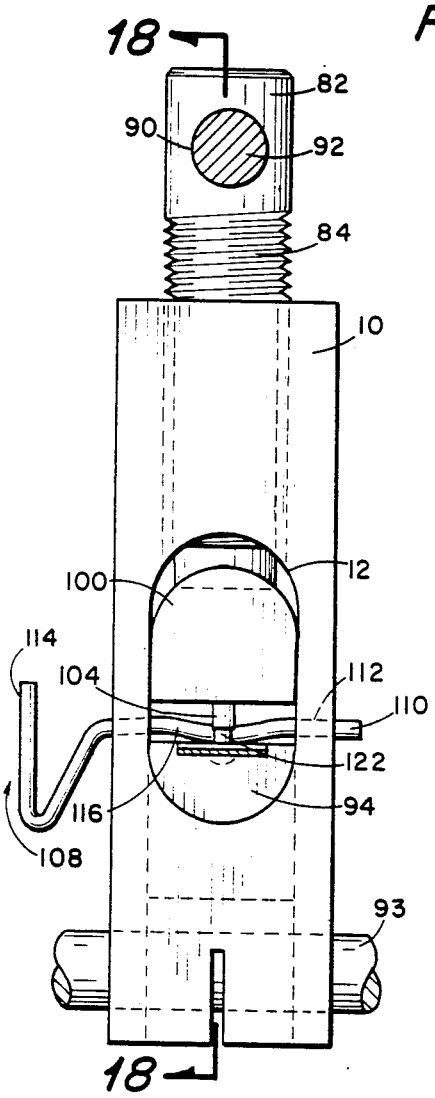
FIG. 17 is a front view, on a slightly enlarged scale, of the device shown in FIG. 2 as employed in a riveting operation and showing a holding pin associated with the device.
Figure 18:
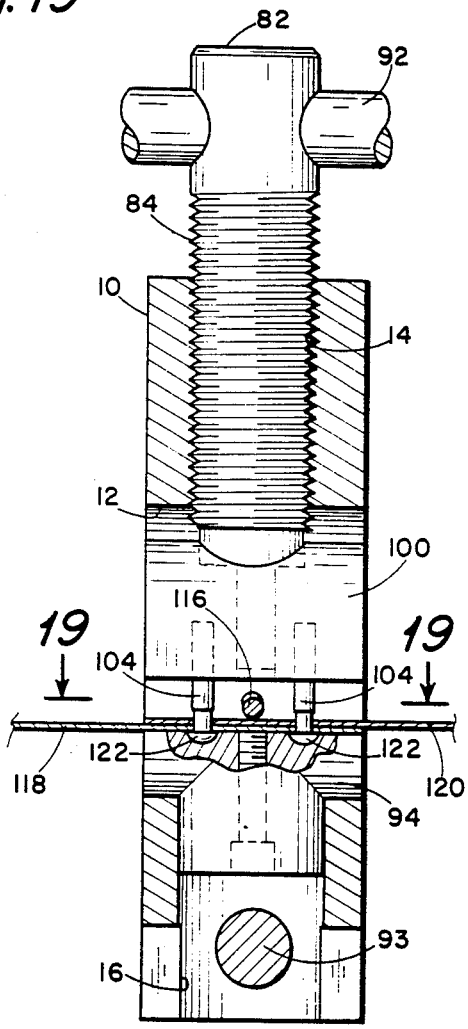
FIG. 18 is a longitudinal cross-sectional view taken along section line 18—18 of FIG. 17.

To assist in maintaining the pieces in proper position during the preliminary stages of the riveting operation a holding pin 108 is provided as shown in FIGS. 17 and 19. This pin 108 has a generally horizontal portion 110 which can be inserted through holes 112 and a right angled handle portion 114 which permits turning of the pin. The horizontal portion 110 is provided with a central bowed portion 116 which is adapted to bear against a pair of metal strips 118 and 120 to hold rivets 122 in position while lowering the upper rivet block 100. As soon as the flaring members 104 contact the rivets 122, the pin 108 can be turned 90° and removed.

What is claimed is:

1. A device for punching holes in a surveyor's chain and in metal pieces used for repairing the chain and for riveting together the punched chain and metal pieces comprising an elongated vertical housing having an elongated vertically oriented opening extending transversely therethrough and defined by a continuous wall, said vertical opening having an upper portion and a lower portion, an upper vertical bore extending from the top of the housing into said upper portion of said opening, the upper portion of said upper vertical bore being threaded, a lower vertical bore extending downwardly from said lower portion of said opening towards the lower end of said housing, a lower rivet block removably received in the lower portion of said opening and having a lower base removably received in the lower vertical bore, said lower rivet block having a flat horizontally extending recess therein whose width is equal to that of the chain to be repaired, said lower rivet block also including a pair of spaced shallow recesses located on said flat recess for receiving the heads of a pair of rivets, an upper rivet block removably received in the upper portion of said opening and in vertically slidable contact with the wall of said opening, said upper rivet block having a lower flat surface and a pair of flaring members projecting downwardly from said flat surface and adapted to flare the upper ends of a pair of rivets supported on said lower rivet block and projecting through a pair of overlapping prepunched metal strips received in said flat recess, an arbor shaft having a threaded portion received in the threaded portion of the upper bore, means for rotating said arbor shaft, the arbor shaft having a lower portion for engaging, upon rotation, the upper end of said upper rivet block for urging the upper rivet block downwardly toward said lower rivet block so as to urge said flaring members against the upper ends of said rivets, whereby, upon continued rotation of said arbor shaft, said flaring members will flare the upper end of said rivets, and means for restraining rotation of the lower end of said housing.

2. The improvement as set forth in claim 1 wherein said housing is provided with a pair of pin holes extending therethrough on opposite sides of said vertical opening in a horizontal position slightly above the upper surface of said lower rivet block, a holding pin having a horizontal portion removably inserted in said pin holes so as to overlie the metal strips received in the flat recess in said lower rivet block, said holding pin having a bowed portion along the central part of said horizontal portion and a right angled handle portion extending from one end of the horizontal portion, whereby the holding pin can be turned so that the bowed portion will engage the metal strips and hold them in position against the lower rivet block while the upper rivet block is inserted into the housing and lowered towards the lower rivet block.

* * * * *